US007534138B1

(12) United States Patent
Gump et al.

(10) Patent No.: US 7,534,138 B1
(45) Date of Patent: May 19, 2009

(54) ELECTRICAL CABLE SHIELDING TERMINAL

(75) Inventors: Bruce S. Gump, Warren, OH (US); Steven A. Musick, Burton, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/001,820

(22) Filed: Dec. 13, 2007

(51) Int. Cl.
*H01R 13/648* (2006.01)

(52) U.S. Cl. ..... 439/564

(58) Field of Classification Search ..... 439/564, 439/607, 610, 98, 99, 939, 550, 559, 562, 439/563, 470
See application file for complete search history.

(56) References Cited

U.S. PATENT DOCUMENTS

| | | | | |
|---|---|---|---|---|
| 3,194,877 | A | 7/1965 | Collier | |
| 3,648,224 | A | 3/1972 | McDonough | |
| 4,090,767 | A | 5/1978 | Tregoning | |
| 4,493,525 | A | 1/1985 | Hall et al. | |
| 4,614,398 | A | 9/1986 | Wright et al. | |
| 4,879,807 | A | 11/1989 | Roucaute | |
| 4,990,104 | A | 2/1991 | Schieferly | |
| 5,028,742 | A | 7/1991 | Redman | |
| 5,199,903 | A | 4/1993 | Asick et al. | |
| 5,755,597 | A * | 5/1998 | Panis et al. | 439/610 |
| 6,231,392 | B1 | 5/2001 | Van Woensel | |
| 6,643,926 | B2 | 11/2003 | Sakaguchi et al. | |
| 6,682,360 | B2 | 1/2004 | Schauer et al. | |
| 6,753,475 | B2 | 6/2004 | Takahashi et al. | |
| 6,921,292 | B2 * | 7/2005 | Miyazaki | 439/564 |
| 6,929,512 | B2 | 8/2005 | Lai | |
| 6,951,483 | B2 | 10/2005 | Kameyama | |
| 7,038,134 | B2 | 5/2006 | Daugherty et al. | |
| 7,101,223 | B2 | 9/2006 | Neumann et al. | |
| 7,228,625 | B1 | 6/2007 | Zerebilov | |
| 2003/0092321 | A1 * | 5/2003 | Schauer et al. | 439/610 |
| 2003/0104727 | A1 * | 6/2003 | Chen et al. | 439/610 |

* cited by examiner

*Primary Examiner*—Alexander Gilman
(74) *Attorney, Agent, or Firm*—Thomas N. Twome

(57) ABSTRACT

A shield terminal engageable with a shield of an electrical cable includes a first member having a first contact surface inclined at an acute angle relative to a longitudinal axis of the terminal and a second member having a second contact surface inclined at an acute angle relative to the longitudinal axis of the terminal. When the shield terminal is attached to the shield the first and second contact surfaces engage the shield. The second contact surface of the second member is disposed adjacent the first contact surface of the first member. A distance between the second contact surface and the first contact surface is less than a thickness of the shield.

24 Claims, 3 Drawing Sheets

FIG 3
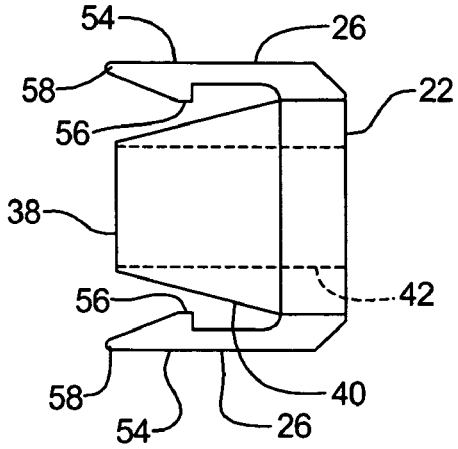
FIG 4
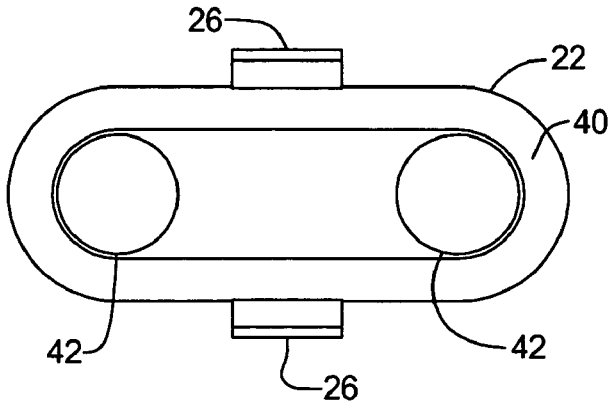
FIG 5
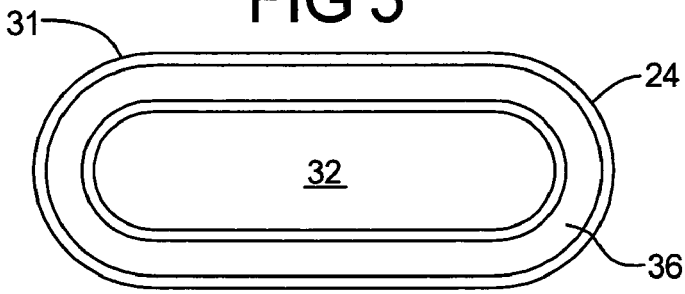
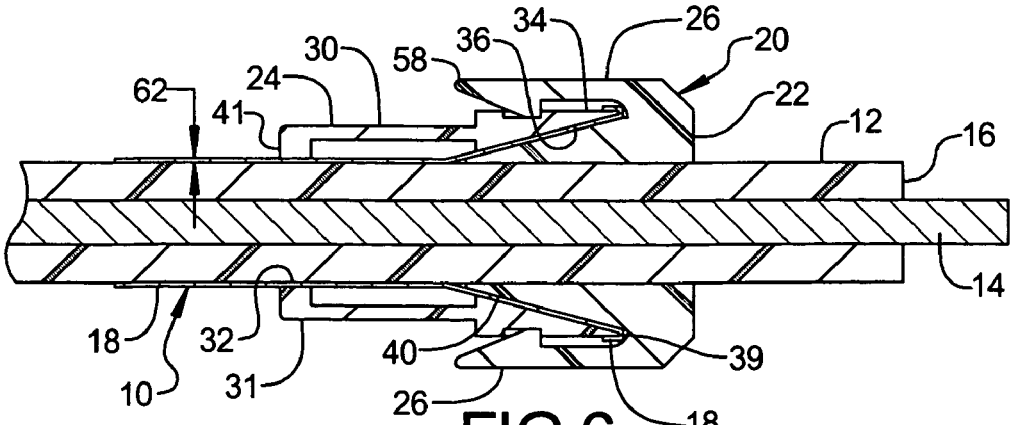
FIG 6

ELECTRICAL CABLE SHIELDING TERMINAL

BACKGROUND

Electromagnetic interference (EMI), also known as radio frequency interference (RFI), is a disturbance in an electrical circuit caused by electromagnetic radiation emitted from an external source. Electric current traveling along an electrical conductor, such as a wire or cable, may generate electromagnetic interference (EMI), and may itself be subject to undesirable interference due to electromagnetic interference from other sources. Disturbances caused by electromagnetic interference may interrupt, obstruct, or otherwise degrade or limit the performance of electrical devices, such as radio receivers, televisions, cell phones, computer systems, and audio equipment. Various methods for limiting the effects of EMI exist. Electromagnetic shielding, for example, may be employed to limit the flow of electromagnetic fields between objects by arranging an electrically conductive barrier between the two objects. In the case of electrical wires and cables, the shielding may include a wire mesh surrounding an inner core conductor. The shielding operates to impede the escape of electromagnetic signals from the core conductor that could interfere with the operation of nearby electrical circuits, as well as preventing electromagnetic signals from being added to the core conductor. To be effective, shielding is generally electrically connected to a suitable ground. A shield terminal is provided for electrically attaching the shield to the ground. A typical shield terminal may include multiple parts having complex shapes that can be time consuming and expensive to produce. The shield terminal is typically connected to the shield utilizing a crimp or mechanical fastener contact method, which may require separate positioning, clamping or crimping tools to achieve a suitable electrical connection between the terminal and the shield.

Accordingly, there is a need in the art for a connection system that secures or fastens a shielding to a terminal, creating and maintaining a good electrical contact, without the use of positioning, clamping or crimping tools.

SUMMARY

Various examples of a shield terminal, and methods for a shield terminal to an electrical cable, are disclosed herein. An illustrative example includes a shield terminal engageable with a shield of an electrical cable having at least one conductor. The shield terminal includes a first member having a first contact surface inclined at an acute angle relative to a longitudinal axis of the terminal, the first contact surface engageable with the shield. The shield terminal further includes a second member having a second contact surface disposed adjacent the first contact surface, the second contact surface inclined at an acute angle relative to the longitudinal axis of the terminal, the second contact surface engageable with the shield, wherein the second contact surface is separated from the first contact surface by a distance less than a thickness of the shield.

An illustrative example of a method for connecting a shield terminal to an electrical cable having a shield and at least one electrical conductor includes sliding a first terminal member over an outer circumference of the shield and sliding a second terminal member over the at least one electrical conductor. The method further includes electrically connecting at least one of the first and second terminal members to the shield by applying opposing axial forces to the first member and the second member urging the two members toward one another and into contact with the shield.

BRIEF DESCRIPTION OF THE DRAWINGS

FIG. 3 is a side elevational view of an inner ferrule employed in the exemplary shield terminal.

FIG. 4 is a longitudinal end view of the inner ferrule employed in the exemplary shield terminal, viewed from an end of the inner ferrule that engages the EMI shield.

FIG. 5 is a longitudinal end view of an outer ferrule employed in the exemplary shield terminal, viewed from an end of the outer ferrule that engages the EMI shield.

FIG. 6 is a longitudinal cross-sectional view of the electrical cable employing the exemplary shield terminal taken along line 6 of FIG. 1.

DETAILED DESCRIPTION

Figure 1:
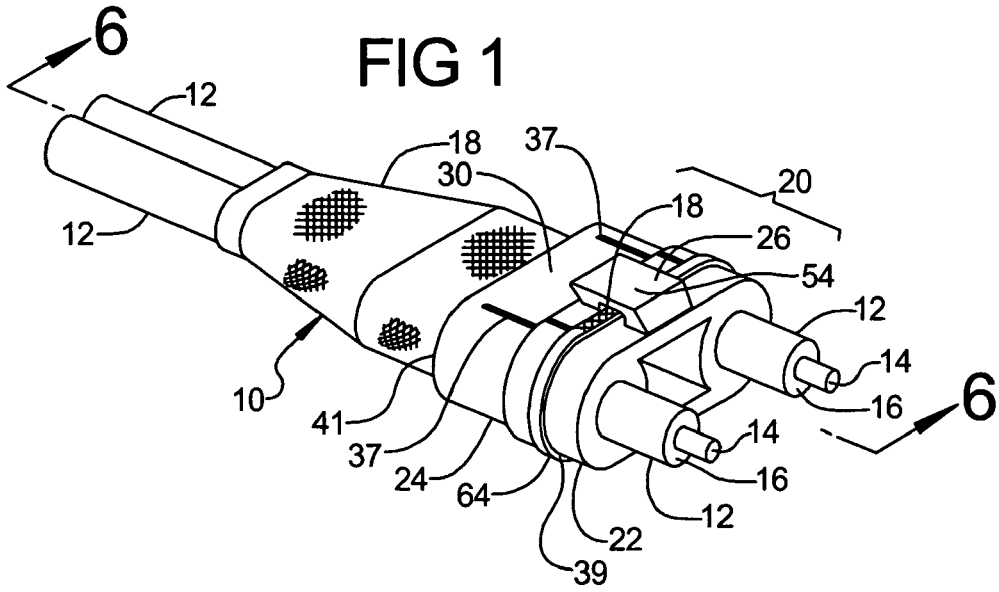
FIG. 1 is a perspective view of an electrical cable incorporating an EMI shield attached to an exemplary shield terminal.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or otherwise limit or restrict the claims to the precise forms and configurations shown in the drawings and disclosed in the following detailed description.

Figure 2:
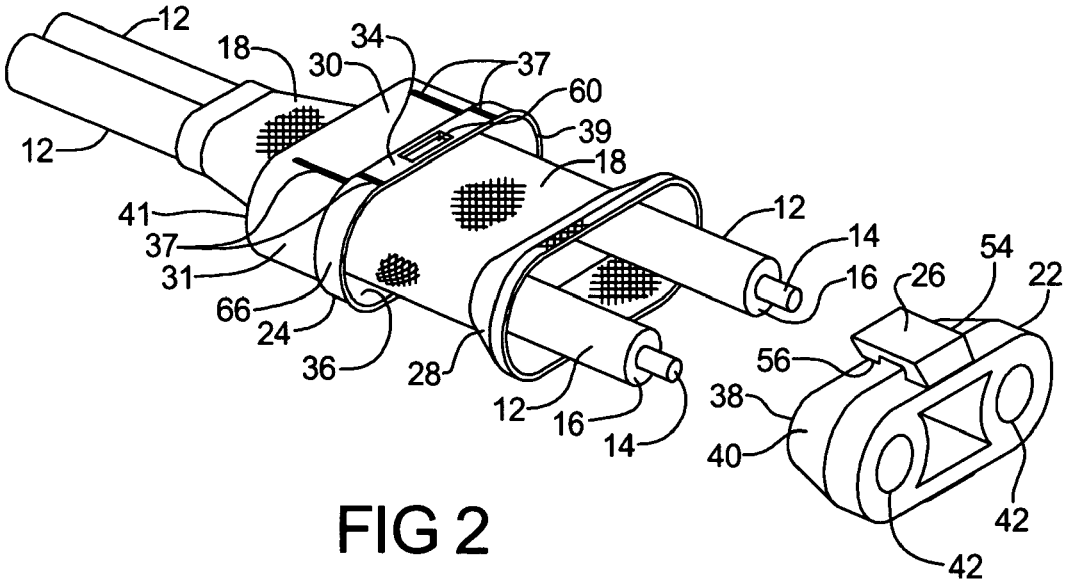
FIG. 2 is a partially exploded perspective view of the electrical cable employing the exemplary shield terminal.

FIGS. 1, 2 and 6 illustrate a shielded electric cable 10 that includes a pair of electrically conductive wires 12. For purposes of discussion, cable 10 is shown to include two wires 12. However, it shall be appreciated that other cable configurations are also possible, including, but not limited to, those having single or multiple wires 12. The configuration of cable 10 may vary depending on the design and performance requirements of the particular application.

Each wire 12 includes an electrically conductive inner core 14 encased in an electrically insulating sheath 16. Core 14 may be constructed of a single strand conductor or may include multiple strands. Although insulating sheath 16 is shown to include a single insulating layer, it shall be appreciated that insulating sheath 16 may nevertheless consist of multiple layers having various physical and operational characteristics.

The flow of electric current is known to cause electromagnetic interference (EMI) that may adversely affect the operation of electrical devices in certain instances. Various techniques are available to try and minimize the undesirable effects of EMI. One such technique involves applying EMI shielding to an electrical device that may either generate EMI or be subject to EMI. The shielding operates to impede the transmission of EMI through the shield. Shielding electrical wire 12, for example, may consist of wrapping the electrical wire in an electrically conductive EMI shield 18. EMI shield 18 may have various configurations, such as a braided blanket or a thin film, as well as other configurations. EMI shield 18 covers as much of the electrical device as possible. In the case of electrical wires, the shielding will generally be applied to the entire length of wire so as to cover the wire from end to end. Areas left uncovered are to be avoided since this may allow EMI to pass through the unprotected areas. It should be noted that, although EMI shield 18 is illustrated as partially covering cable 10, this was done for purposes of discussion and illustrative convenience, and it shall be understood that, in practice, EMI shield 18 will generally be applied to substantially the entire length of wire 12 to minimize areas through which EMI can pass. When installed in an electrical device, EMI shielding 18 is typically connected to a suitable ground.

EMI shield 18 may be constructed from a variety of materials using a variety of methods. For example, EMI shield 18 may be made from an electrically conductive material, such as copper. The shield may be formed by interweaving thin wires to form a braided blanket that can be wrapped around cable 10. EMI shield 18 may also be constructed as a thin film of electrically conductive material, which likewise can be wrapped around cable 10. Either configuration may be used separately or in combination with one another. It shall be understood, however, that these are just two examples of the types of EMI shielding that can be employed with cable 10, and is not intended to be in any way limiting, as other configurations may also be utilized depending on the design and operational requirements of a particular application. Although a single EMI shield 18 is illustrated, it shall also be appreciated that multiple shields may be employed in an effort to further reduce EMI transmission. EMI shield 18 may be bonded or otherwise incorporated into insulating sheath 16.

EMI shield 18 is generally attached to a suitable ground when cable 10 is attached to an electrical device. To assist with connecting EMI shield 18 to the electrical device, a shield terminal 20 is provided. Shield terminal 20 electrically engages EMI shield 18 to provide a convenient and secure terminal for electrically connecting EMI shield 18 to the electrical device.

Shield terminal 20 includes an inner ferrule 22 disposed adjacent an outer ferrule 24. Inner and outer ferrules 22 and 24 are connected together by means of a locking device or connector 26. In one embodiment, outer ferrules 22 and 24 are connected in a snap-fit configuration using the locking device or connector 26. EMI shield 18 is attached to shield terminal 20 by trapping a portion 28 of EMI shield 18 (see FIG. 2) between inner ferrule 22 and outer ferrule 24 when the two ferrules are assembled together. Either one or both of inner and outer ferrules 22,24 can provide an effective means for electrically connecting EMI shield 18 to the electrical device. For instance, an outer portion 30 of outer ferrule 24 may be suitably configured to connect to a connector on the electrical device to which the cable is attached.

Referring also to FIG. 5, outer ferrule 24 is shown to have a generally tubular shaped body 31 defining a wire opening 32 for receiving wires 12 and EMI shield 18 when outer ferrule 24 is assemble to cable 10. Although illustrated as having a generally oval or oblong shape when viewed along a longitudinal axis of the ferrule, outer ferrule 24 may also be configured to have any of a variety of other shapes depending on the structural requirements of the particular application. For example, in instances in which cable 10 includes a single wire 12 it may be desirable to provide outer ferrule 24 with a generally circular shape to coincide with the shape of the single wire. If, on the other hand, cable 10 consists of multiple wires bundled together to form a single cable, it may be desirable to provide outer ferrule 24 with a generally polygonal shape to coincide with the outer profile of the wire bundle.

It is not necessary that an outer periphery of outer ferrule 24 coincide with the shape of wire opening 32. Outer ferrule 24 may have a different outer peripheral shape depending on the configuration of the connector to which ferrule 24 attaches.

Figure 7:
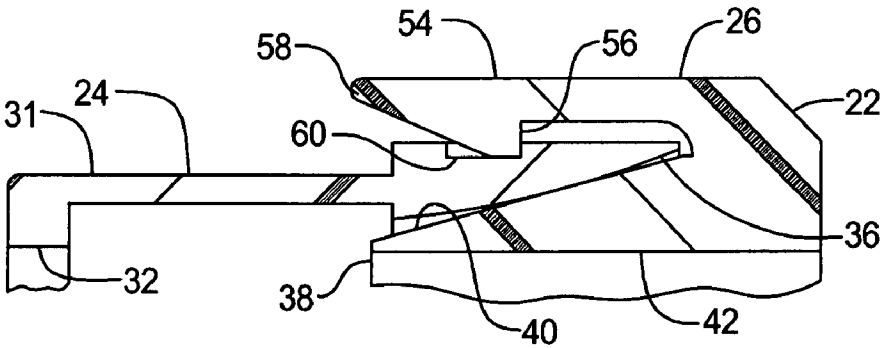
FIG. 7 is an enlarged cross-sectional view of the inner ferrule attached to the outer ferrule without the shield, the outer ferrule employing a modified shield contact surface contour.
Figure 8:
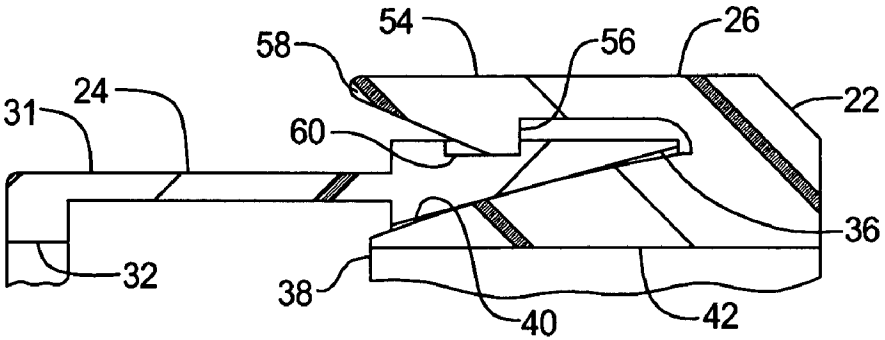
FIG. 8 is an enlarged cross-sectional view, similar to FIG. 7, of the inner ferrule attached to the outer ferrule without the shield, the inner ferrule employing a modified shield contact surface contour.

Continuing to refer to FIGS. 2 and 6, a longitudinal end 34 of outer ferrule 24, which is disposed adjacent inner ferrule 22 when the inner and outer ferrules are attached to one another, includes an inwardly tapered shield contact surface 36 that at least partially engages EMI shield 18 when shield terminal 20 is attached to EMI shield 18. Shield contact surface 36 may have a generally flat contour, as shown in FIG. 8, or may be convex as shown in FIG. 7.

With reference to FIGS. 1 and 2, outer ferrule 24 may include one or more slits 37 positioned around the circumference of outer ferrule 24. Each slit 37 extends from a forward distal end 39 of outer ferrule 24, and back toward a rear distal end 41. The slits reduce the hoop strength of outer ferrule 24, allowing end 34 or outer ferrule 24 to more easily deflect outward when outer ferrule 24 is attached to inner ferrule 22 and EMI shield 18. Increasing the length of slit 37 decreases the force required to deflect end 34 of outer ferrule 24 outward, which in turn reduces the force exerted by outer ferrule 24 and inner ferrule 22 on EMI shield 18 when shield terminal 20 is attached to EMI shield 18.

Outer ferrule 24 may be made from any of a variety of materials. Selection of a suitable material will depend, at least in part, on whether outer ferrule 24 is to provide an electrical connection between EMI shield 18 and the electrical device to which cable 10 is attached. If outer ferrule 24 is to be electrically conductive, such as when outer ferrule 24 is used to connect EMI shield 18 to the electrical device to which the cable is attached, outer ferrule 24 may be constructed from brass or another material having similar properties. Outer ferrule 24 may also include a tin plating to help ensure good electrical contact between shield terminal 20 and EMI shield 18. If it is not necessary that outer ferrule 24 be electrically conductive, the ferrule may be constructed from any of a variety of non-metallic materials, such as plastic or a composite material, among others. One design consideration when using a non-metallic material is to avoid selecting a material that may be susceptible to creeping, or have other similar characteristics, which could loosen the electrical connection between shield terminal 20 and EMI shield 18.

Referring also to FIGS. 3 and 4, shield terminal 20 includes inner ferrule 22 that attaches to outer ferrule 24, thereby trapping EMI shield 18 between the two ferrules. Inner ferrule 22 has a tapered end 38 forming a shield contact surface 40. When inner ferrule 22 and outer ferrule 24 are assembled together, tapered end 38 of inner ferrule 22 is at least partially disposed within tapered end 34 (see FIG. 2) of outer ferrule 24. Shield contact surface 40 of inner ferrule 22 may have a generally flat contour, as shown in FIG. 7, or may be convex as shown in FIG. 8.

Inner ferrule 22 may be made from any of a variety of materials. The material selected will depend, at least in part, on whether inner ferrule 22 needs to be electrically conductive, such as when the inner ferrule electrically connects EMI shield 18 to the electrical device to which cable 10 is attached. Inner ferrule 22 may also have softer surface properties than outer ferrule 24 so as to allow a certain degree of surface deflection of inner ferrule 22 when shield terminal 20 is attached to EMI shield 18. Suitable materials may include annealed copper, magnesium and zinc, as well as others. If inner ferrule does not need to be electrically conductive, inner ferrule 22 may be constructed from a non-metallic material, such as plastic or a composite material, among others. One design consideration when using a non-metallic material is to avoid selecting a material that may be susceptible to creeping, or have similar characteristics, which could loosen the electrical connection between shield terminal 20 and EMI shield 18.

Continuing to refer to FIGS. 3 and 4, inner ferrule 22 may include a pair of apertures 42 for receiving wires 12. In instances where cable 10 includes a different number of wires 12, a separate aperture can be provided for each wire. For example, if cable 10 includes three wires, inner ferrule 22 may also include three apertures, one for each wire. Providing separate apertures for each wire helps prevent the wires from becoming entangled during assembly of terminal shield 20 to EMI shield 18 and aids the connection of cable 10 to the electrical device.

It is not necessary that shield contact surface 40 have the same surface contour as shield contact surface 36 of outer ferrule 24. For example, the surface contour of shield contact surface 40 of inner ferrule 22 may be convex, whereas the surface contour of shield contact surface 36 of outer ferrule 24 may have a generally flat surface contour, as shown in FIG. 8. Conversely, shield contact surface 40 of inner ferrule 22 may have a generally flat surface contour and shield contact surface 36 of outer ferrule 24 may be convex, as shown in FIG. 7. Furthermore, shield contract surface 40 of inner ferrule 22 and shield contact surface 36 of outer ferrule 24 may both have a generally flat contour, as illustrated in FIG. 6, or both surfaces may have a generally convex surface contour.

Figure 9:
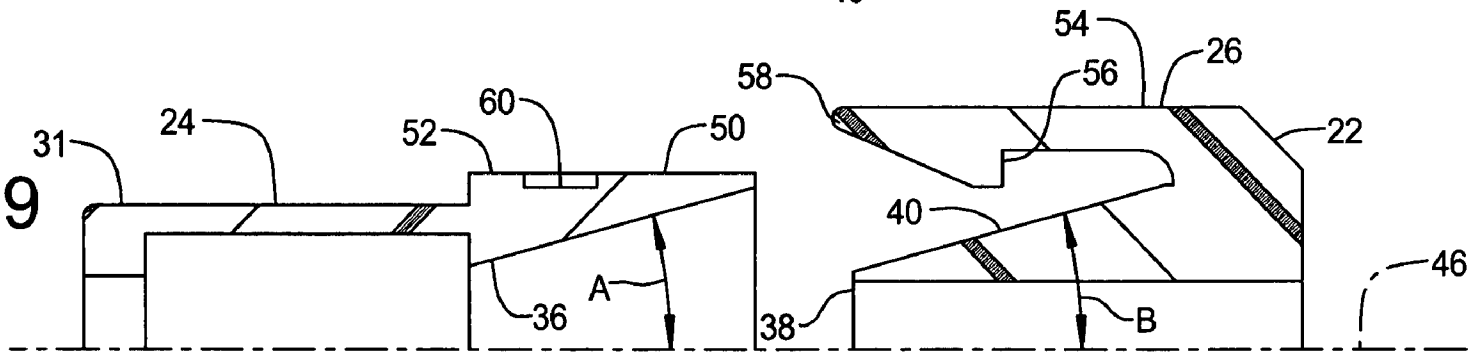
FIG. 9 is an enlarged cross-sectional view of the inner ferrule detached from the outer ferrule.

Referring also to FIG. 9, shield contact surface 36 of outer ferrule 24 is inclined at an acute angle "A" relative to longitudinal axis 46 of shield terminal 20. Shield contact surface 40 of inner ferrule 22 is likewise inclined at an acute angle "B" relative to longitudinal axis 46 of shield terminal 20. Shield contact surface 36 of outer ferrule 24 and shield contact surface 40 of inner ferrule 22 may have substantially the same angle of inclination. It is not necessary that the angle of inclination be uniform around an entire circumference of the shield contact surfaces. If a variable angle of inclination is utilized, the shield contact surfaces of the inner and outer ferrules generally have substantially the same angle of inclination at common circumferential locations.

To help ensure uniform contact between inner and outer ferrules 22 and 24 and EMI shield 18, it may also be desirable to configure shield contact surfaces 36 and 40 of ferrules 24 and 22, respectively, to initially have different angles of inclination when the two ferrules are not connected, as illustrated in FIG. 9. When shield terminal 20 is attached to EMI shield 18, the forces generated during the assembly process will cause a thinner end region 50 of outer ferrule 24 to deflect outward more than a thicker region 52, which effectively increases the incidence angle of shield contact surface 36 of outer ferrule 24. A pre-installation angle of incidence of shield contact surface 36 of outer ferrule 24 can be determined that will maximize the contact area between inner and outer ferrules 22 and 24 and EMI shield 18.

Inner ferrule 22 may also include one or more connectors 26 for securely attaching inner ferrule 22 to outer ferrule 24. Connector 26 may have any of a variety of different configurations. An example of one such configuration is illustrated and may include a flexible connector arm 54 cantilevered from inner ferrule 22. A tab 56 extends inward from an end 58 of connector arm 54. Tab 56 engages a corresponding aperture 60 in outer ferrule 24 when inner ferrule 22 is attached to outer ferrule 24. Connector 26 is configured such that, without attaching shield terminal 20 to EMI shield 18, the distance between shield contact surface 40 of inner ferrule 22 and shield contact surface 36 of outer ferule 24 is less than a thickness 62 (see FIG. 6) of EMI shield 18 when the two ferrules are connected. It shall be appreciated that other means for securing inner ferrule 22 to outer ferrule 24 may also be provided, such as latches, screws, rivets, snaps, and adhesive, among others.

Continuing to refer to FIGS. 1 and 2, shield terminal 20 can be attached to EMI shield 18 by sliding outer ferrule 24 over cable 10 and EMI shield 18. Outer ferrule 24 is positioned proximate end 28 of EMI shield 18. An end portion 64 of EMI shield 18 can be folded back over an outer periphery 66 of outer ferrule 24 so as to be viewable from outside shield terminal 20 when the shield terminal is attached to EMI shield 18. In addition to facilitating attachment of outer ferrule 24 to inner ferrule 22, leaving a portion of the EMI shield 18 exposed also provides visual confirmation that shield terminal 20 is fully engaging EMI shield 18. Inner ferrule 22 is then attached to outer ferrule 24 by feeding wires 12 through their respective apertures 42 in inner ferrule 22. Inner ferrule 22 is linearly slid along the length of wires 12 to a position proximate end 28 of EMI shield 18. With outer ferrule 24 positioned adjacent inner ferrule 22, an inner surface of EMI shield 18 overlaps shield contact surface 40 of inner ferrule 22, and an outer surface of EMI shield 18 overlaps shield contact surface 36 of outer ferrule 24. The assembly is competed by applying opposing axial forces to inner ferrule 22 and outer ferrule 24 so as to linearly engage the two ferrules with sufficient force to enable tab 56 of connector 26 to engage aperture 60 of outer ferrule 24. Inner ferrule 22 and outer ferrule 24 forcibly engage EMI shield 18, trapping EMI shield 18 between shield contact surface 40 of inner ferrule 22 and shield contact surface 36 of outer ferrule 24. Shield terminal 20 can be disassembled from EMI shield 18 by reversing the above described process.

With regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A shield terminal engageable with a shield of an electrical cable having at least one conductor, the shield terminal comprising:

a first member having a first contact surface inclined at an acute angle relative to a longitudinal axis of the terminal, the first contact surface engageable with the shield;

a second member having a second contact surface disposed adjacent the first contact surface, the second contact surface inclined at an acute angle relative to the longitudinal axis of the terminal, the second contact surface engageable with the shield, wherein the second contact surface is separated from the first contact surface by a distance less than a thickness of the shield; and a connector extending from a portion of the second member, the connector being configured to fixedly engage the first member.

2. The shield terminal of claim 1, wherein a distal end of the first member is axially interposed between opposite distal ends of the second member, the distal end of the first member and an outer surface of the second member define sides of a passage for receiving the shield.

3. The shield terminal of claim 1, wherein the first contact surface defines an aperture, the second contact surface at least partially disposed within the aperture defined by the first contact surface.

4. The shield terminal of claim 1, wherein the first contact surface and the second contact surface have substantially the same angle of inclination.

5. The shield terminal of claim 1, wherein the angle of inclination of the first contact surface is less than the angle of inclination of the second contact surface.

6. The shield terminal of claim 1, wherein the connector includes an arm cantilevered from the second member and configured to engage an aperture in the first member.

7. The shield terminal of claim 1, wherein the connector comprises a flexible clip attached to one of the first and second members and releasably engaging the remaining member.

8. The shield terminal of claim 1, wherein at least one of the first contact surface and the second contact surface has at least a partially convex surface contour.

9. The shield terminal of claim 1, wherein the second member further comprises at least one aperture for separately receiving each of the at least one conductors of the electrical cable.

10. The shield terminal of claim 1, wherein the connector is configured to engage the first member and the second member in a snap-fit configuration.

11. The shield terminal of claim 1, wherein the second member is configured to allow a degree of surface deflection when engaged with the shield.

12. The shield terminal of claim 1, wherein surface properties of the second member are softer than surface properties of the first member to allow for surface deflection in the second member when engaged with the shield.

13. A shield terminal engageable with a shield of an electrical cable having at least one conductor, the shield terminal comprising:

a first member having a first contact surface inclined at an acute angle engageable with the shield; and a second member having a second contact surface disposed adjacent the first contact surface, the second contact surface engageable with the shield and inclined at an acute angle relative to the first contact surface and separated by a distance less than a thickness of the shielding element;

wherein the first member linearly engages the second member.

14. The shield terminal of claim 13, wherein at least one of the first and second contact surfaces is inclined relative to a longitudinal axis of the shield terminal.

15. The shield terminal of claim 13, further comprising a connector connecting the first member to the second member in a snap-fit configuration.

16. The shield terminal of claim 15, wherein the connector includes an arm extending from one of the first and second members and releasably engaging the remaining member.

17. The shield terminal of claim 13, wherein first contact surface defines an aperture for receiving the second contact surface.

18. A shielded electrical cable comprising:

at least one electrical conductor;

a shield operably connected to the at least one electrical conductor;

a shield terminal having a first member at an acute angle and a second member at an acute angle, the second member being disposed adjacent the first member, and the first member being axially displaced away from the second member so as to define a space between the first and second members, the shield disposed within the space and fixedly engaging at least one of the first and second members; and a latch connecting the first member to the second member in a snap-fit configuration.

19. The shielded electrical cable of claim 18, wherein the first member includes a shield contact surface inclined relative to a longitudinal axis of the electrical cable and which engages a side of the shield, and the second member includes a shield contact surface inclined relative to the longitudinal axis of the electrical cable and which engages a side of the shield opposite the side engaged by the shield contact surface of the first member.

20. The shielded electrical cable of claim 19, wherein at least one of the contact surface of the first member and the contact surface of the second member has at least a partially convex surface contour.

21. The shielded electrical cable of claim 18, wherein the shield contact surface of the first member and the shield contact surface of the second member are both inclined at an acute angle relative to the longitudinal axis of the electrical cable, the angle of inclination of the shield contact surface of the second member being greater than the angle of inclination of the shield contact surface of the first member.

22. The shielded electrical cable of claim 18, wherein the shield extends beyond an outer periphery of both the first and second members.

23. The shielded electrical cable of claim 18, wherein the latch includes a clip fixedly attached to one of the first and second members and releasably connected to the remaining member.

24. The shielded electrical cable of claim 18, wherein at least one of the first and second members further includes at least one aperture for separately receiving each of the at least one electrical conductors, wherein each of the at least one electrical conductors is disposed within a separate aperture.

* * * * *